US007377818B2

(12) United States Patent
Hetzer et al.

(10) Patent No.: US 7,377,818 B2
(45) Date of Patent: May 27, 2008

(54) PRESSURE MODULE

(75) Inventors: Ulrich Hetzer, Berlin (DE); Frank Moessner, Berlin (DE)

(73) Assignee: ADC GmbH (DE)

( * ) Notice: Subject to any disclaimer, the term of this patent is extended or adjusted under 35 U.S.C. 154(b) by 0 days.

(21) Appl. No.: 11/370,608

(22) Filed: Mar. 8, 2006

(65) Prior Publication Data

US 2006/0209509 A1 Sep. 21, 2006

(30) Foreign Application Priority Data

Mar. 9, 2005 (DE) ..... 10 2005 012 370

(51) Int. Cl.
*H01R 24/00* (2006.01)

(52) U.S. Cl. ..... 439/676; 439/540.1

(58) Field of Classification Search ..... 439/134, 439/135, 136, 395, 404, 460, 469, 540.1, 439/472, 676

See application file for complete search history.

(56) References Cited

U.S. PATENT DOCUMENTS

| | | | | |
|---|---|---|---|---|
| 5,588,871 | A | 12/1996 | Salvaneschi | |
| 5,762,518 | A * | 6/1998 | Tanigawa et al. | 439/409 |
| 5,957,720 | A * | 9/1999 | Boudin | 439/417 |
| 6,077,122 | A | 6/2000 | Elkhatib et al. | |
| 6,159,048 | A | 12/2000 | Van Koetsem et al. | |
| 6,238,236 | B1 | 5/2001 | Craft, Jr. | |
| 6,287,149 | B1 | 9/2001 | Elkhatib et al. | |
| 6,375,507 | B1 | 4/2002 | Van Koetsem et al. | |
| 6,780,054 | B2 | 8/2004 | Yip et al. | |
| 6,848,943 | B2 | 2/2005 | Machado et al. | |
| 6,890,213 | B2 | 5/2005 | Ohtsuki | |
| 6,905,368 | B2 | 6/2005 | Mashiyama et al. | |
| 6,953,362 | B2 | 10/2005 | Mossner et al. | |
| 7,025,621 | B2 | 4/2006 | Mossner et al. | |
| 7,033,219 | B2 | 4/2006 | Gordon et al. | |
| 2001/0046812 | A1 | 11/2001 | Fonteneau et al. | |
| 2003/0171024 | A1 | 9/2003 | Mossner et al. | |
| 2005/0277335 | A1 | 12/2005 | Gordon et al. | |
| 2006/0003623 | A1 | 1/2006 | Mossner et al. | |
| 2006/0216993 | A1 | 9/2006 | Hetzler et al. | |

FOREIGN PATENT DOCUMENTS

| | | |
|---|---|---|
| DE | 196 04 564 | 3/1997 |
| DE | 694 15 645 | 5/1999 |
| DE | 600 06 916 | 10/2004 |
| EP | 0 653 804 | 12/1998 |
| EP | 1 087 472 | 12/2003 |
| WO | WO 02/15339 | 2/2002 |

OTHER PUBLICATIONS

Exhibit A: Notice of Allowance, mailed Sep. 27, 2007 in co-pending U.S. Appl. No. 11/370,573, filed on Mar. 8, 2006, which has an overlapping disclosure with the pending case.

(Continued)

*Primary Examiner*—Khiem Nguyen
(74) *Attorney, Agent, or Firm*—Merchant & Gould P.C.

(57) ABSTRACT

The invention relates to a pressure module for locking a female connector in a connecting socket, comprising a guide body, a spring and a cable fixing element, with the spring being able to act on the cable fixing element.

7 Claims, 5 Drawing Sheets

OTHER PUBLICATIONS

Exhibit B: Ammendment Under 37 C.F.R. § 1.116, filed Sep. 13, 2007 in U.S. Appl. No. 11/370,573.
Exhibit C: Office Action mailed Jun. 28, 2007 in U.S. Appl. No. 11/370,573.
Exhibit D: Ammendment filed Jun. 13, 2007 in U.S. Appl. No. 11/370,573.
Exhibit E: Office Action mailed Feb. 15, 2007 in U.S. Appl. No. 11/370,573.

* cited by examiner

F - F

PRESSURE MODULE

The invention relates to a pressure module for locking a female connector in a connecting socket.

Connecting sockets of this type for telecommunications and data technology usually comprise a plastic housing, in which one or two female connectors are usually arranged. In this case, from the front side, the female connector forms a holder for a matching male connector, with it being possible to connect a cable from the rear side.

DE 196 04 564 C1 discloses a connecting socket for a data network, said connecting socket having a metallic housing lower part, which has a standing surface that is fitted such that it rests against a wall, having a metallic housing upper part and having a circuit board, which is contained between the housing lower part and the housing upper part and bears at least one data receptacle and a plurality of wire connecting terminals to which the individual cores of a multicore data cable can be connected. In this case, the metallic lower part is used to make a ground connection to the circuit board, which connection can then be used, for example, to connect the cable's shield to the housing ground. A covering plastic cap is then pulled over the housing upper part and the housing lower part.

The invention is based on the technical problem of mechanically locking a female connector in a connecting socket in a simpler manner.

In this respect, the pressure module comprises a guide body, a spring and a cable fixing element, with the spring being able to act on the cable fixing element. In this case, the pressure module is inserted from the rear side of the housing. In the simplest case, the cable fixing element acts to relieve the strain on the cable and to mechanically lock the female connector that has been inserted. The spring ensures good force tracking, so that data cables having different diameters can also be fixed in a very simple manner.

In one preferred embodiment, the cable fixing element is made of metal or metallized plastic. This also makes it possible, when using shielded data cables, to electrically connect a cable shield in a very simple manner, with the spring ensuring good force tracking.

In another preferred embodiment, the cable fixing element has at least one latching lug and the guide body has at least one latching groove, so that the spring can be latched, with prestress, into the guide body. This makes it possible for the guide body to be inserted first of all into the housing in a very simple manner and to be latched to the latter. Afterward, a tool can then be used, for example, to push the latching lug out of the latching groove, so that, owing to the spring, the cable fixing element presses against the data cable and fixes the latter.

In another preferred embodiment, the cable fixing element has three latching lugs, with two latching lugs being arranged laterally on that side which faces the spring and one latching lug being arranged laterally on that side which faces the cable.

In another preferred embodiment, the guide body has sawtooth profiling on the inside of the sides. Together with the two rear latching lugs on the cable fixing element, this prevents the cable fixing element from sliding back and thus prevents the data cable from bending up.

In another preferred embodiment, the cable fixing element has a contact tab. The contact tab is used to make a second electrical connection to a metallization of a housing of the connecting socket, thus reducing the transfer impedance. To this end, the contact tab is preferably bent in the direction of the spring.

One preferred area of application for the pressure module is to lock a female connector in a plastic housing, with the inner surfaces of the plastic housing being at least partially metallized. This makes it possible to dispense with a separate plastic cap, since the plastic housing is not externally metallized. In comparison with the prior art, however, this eliminates at least one part. Another advantage of the metallized plastic housing is the lighter weight and the fact that it can be fastened to covers or the like in a simpler manner, in which case recourse can be had to the latching connections known from plastics technology.

In one preferred embodiment, two female connectors are arranged in the housing, with the housing having a wall (which is completely metallized) between the two female connectors. This metallized wall acts as a shield between the two female connectors and prevents crosstalk from one female connector to the other (alien crosstalk) irrespective of whether the cables are shielded or unshielded data cables.

In another preferred embodiment, the wall has a cutout in order to accommodate a latching lug of the female connectors.

In another preferred embodiment, the female connectors have contact pairs for symmetrical cables, with the metallization of the plastic housing being patterned in such a manner that the capacitive coupling between the contacts in a contact pair and the metallization is the same. This is based on the knowledge that asymmetric capacitive coupling between the contact pairs and the metallization results in asymmetric input into, and output from, ground, thus leading to "alien crosstalk", in particular at the high transmission frequencies of Cat 6 and 10 Gbit/s Ethernet. Partial areas without metallization are used to achieve symmetric coupling to the metallization, since the position of the contact pairs in the female connector is known. The same housing can thus be simultaneously used for UTP (Unshielded Twisted Pair) or STP (Shielded Twisted Pair) cables and can comply with the requisite crosstalk values for 10 Gbit/s Ethernet and STP Cat 6.

In another preferred embodiment, the plastic housing is injection-molded from two plastics, with the outer plastic preferably being a polycarbonate and the inner plastic preferably being ABS, which can be subjected to electrodeposition in a considerably easier manner than polycarbonate. In this case, the metallization is preferably applied to the plastic by means of electrodeposition, since the resistances which can be achieved thereby are lower than those which can be achieved using vacuum platinization or similar methods.

As regards one preferred embodiment of the female connector, reference is made to WO 02/15339, to whose disclosure content reference is hereby expressly made.

The invention will be explained in more detail below using one preferred exemplary embodiment. In the figures.

Figure 1:
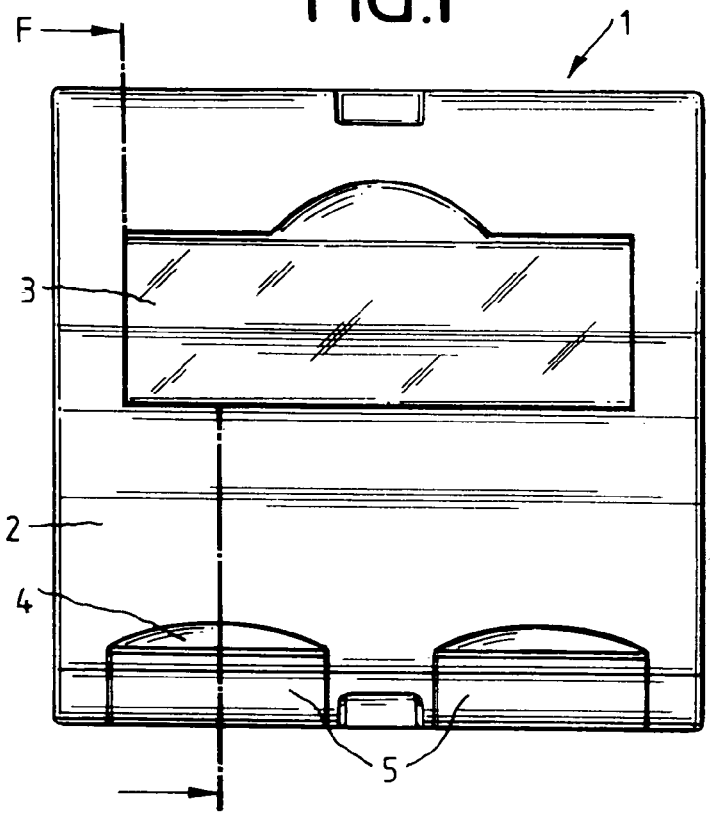
FIG. 1 shows a front view of the front side of a connecting socket.
Figure 3:
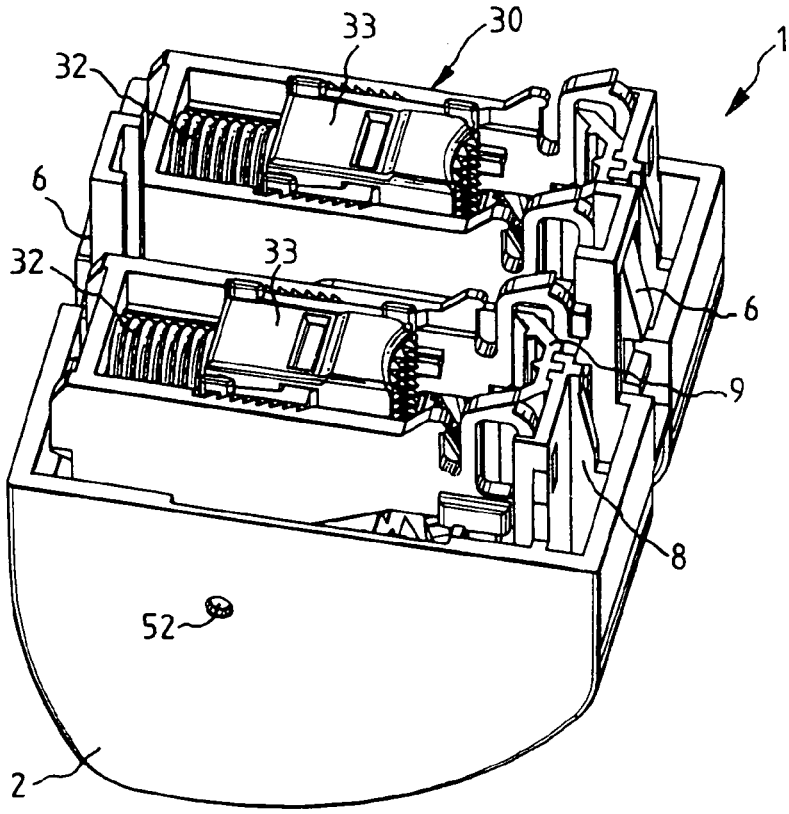
Figure 4:
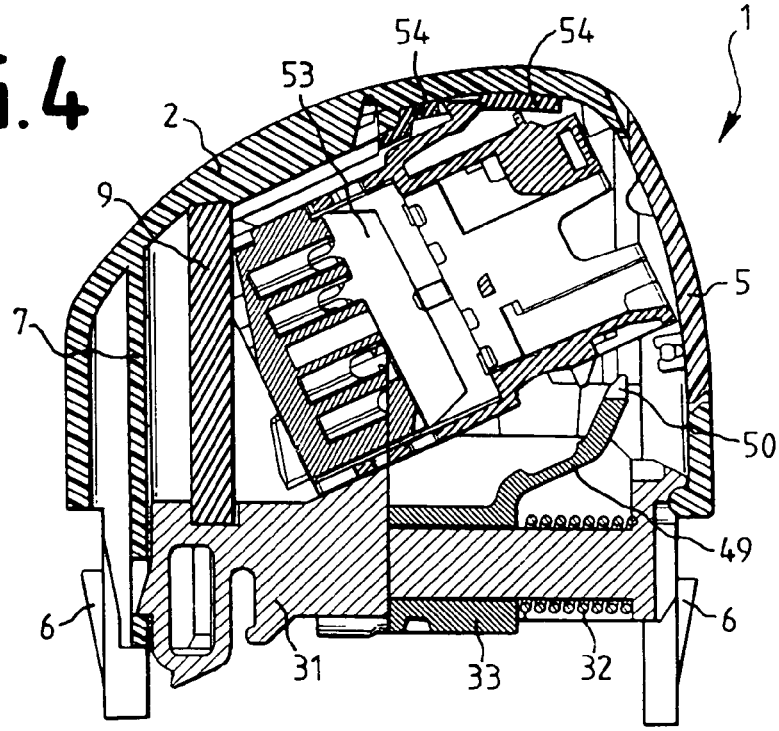
Figure 7:
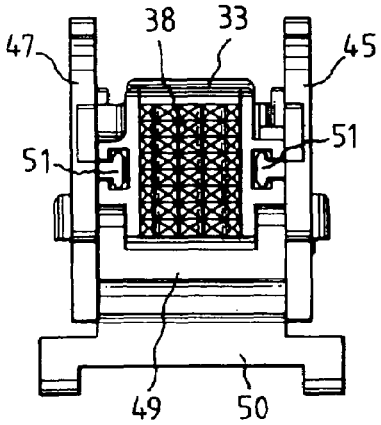
Figure 6:
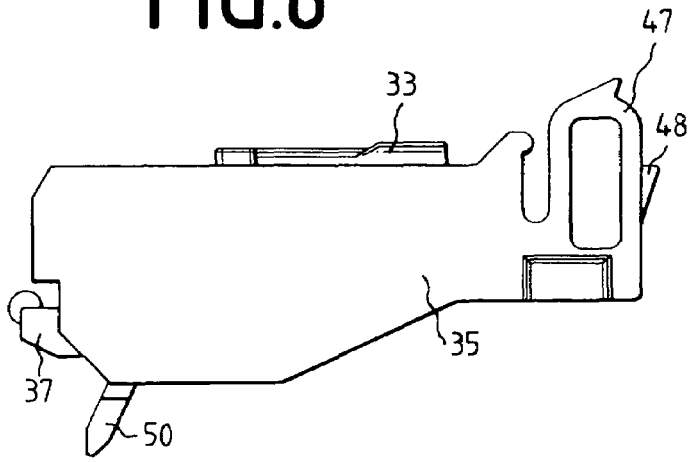
Figure 5:
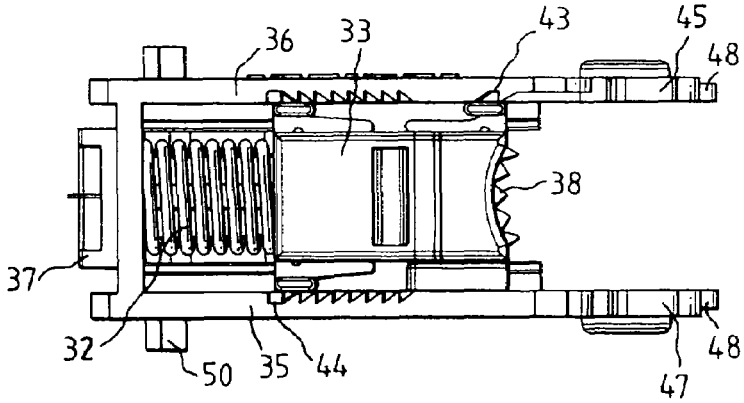
Figure 8:
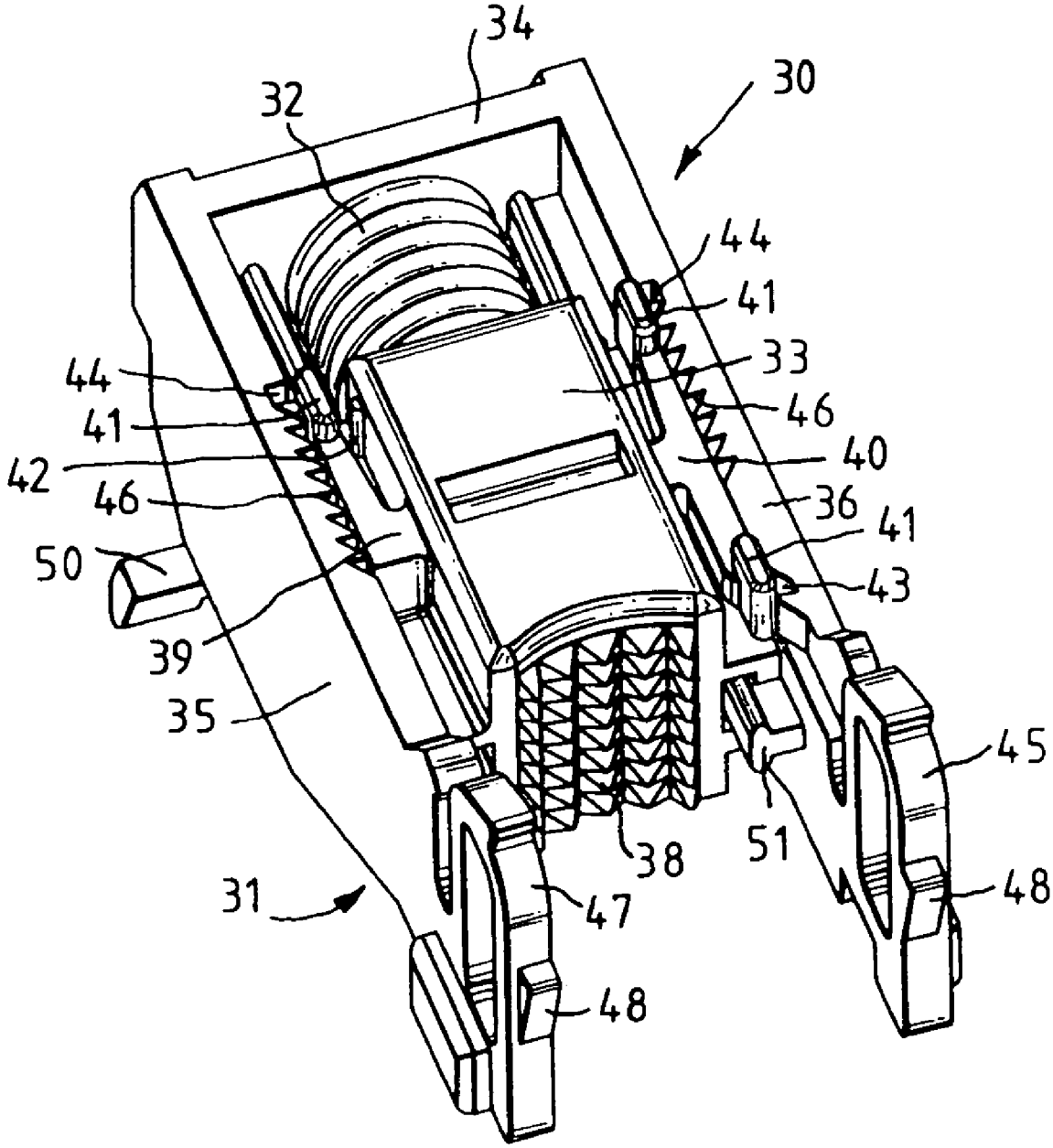
Figure 9:
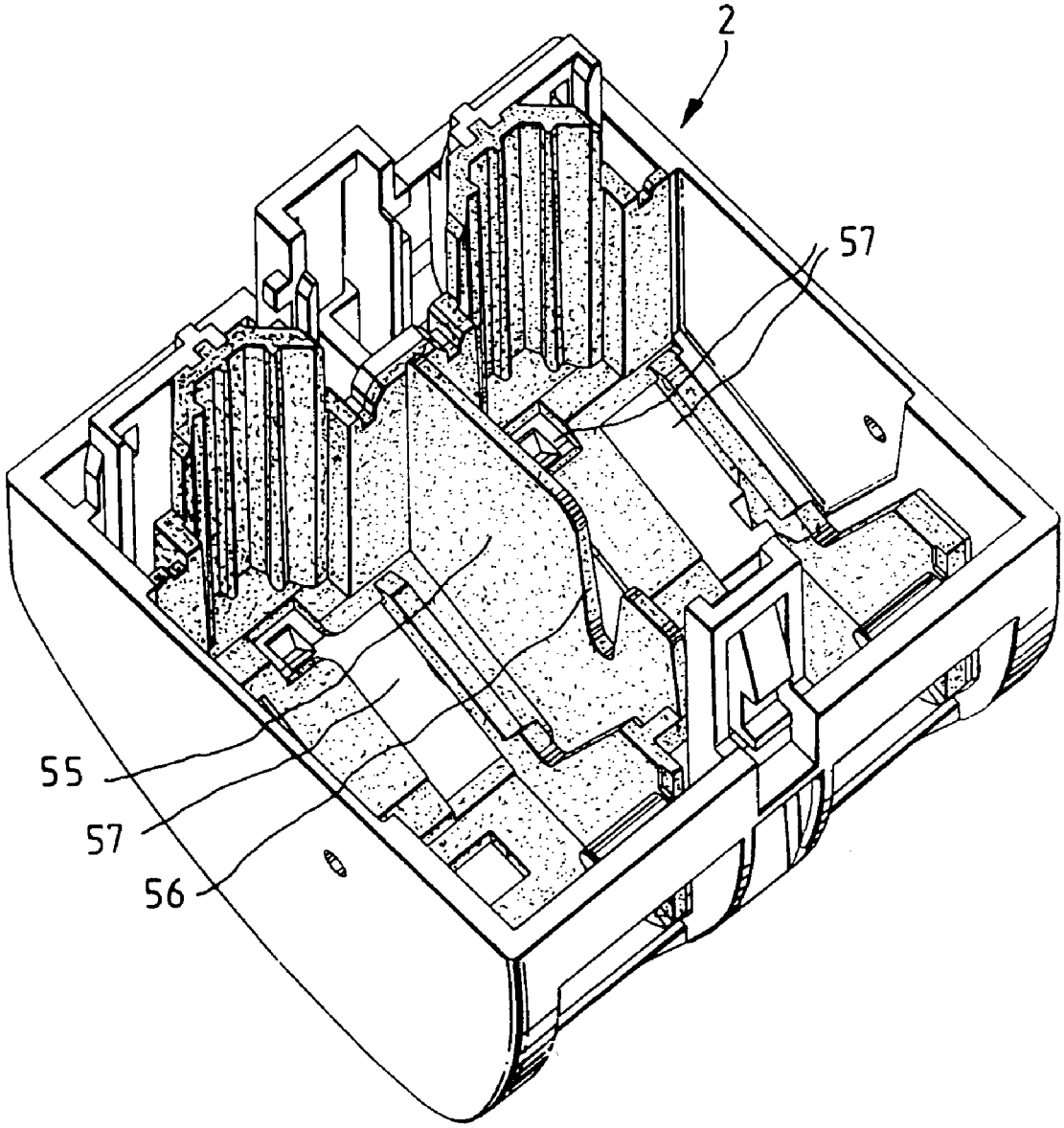

FIG. 3 shows a perspective rear view of the connecting socket with the pressure modules inserted, FIG. 4 shows a section illustration through the connecting socket along the section line F-F as shown in FIG. 1, FIG. 5 shows a plan view of the pressure module, FIG. 6 shows a side view of the pressure module, FIG. 7 shows a front view of the pressure module, FIG. 8 shows a perspective illustration of the pressure module, and FIG. 9 shows a perspective rear view of the housing without the female connectors and pressure modules.

Figure 2:
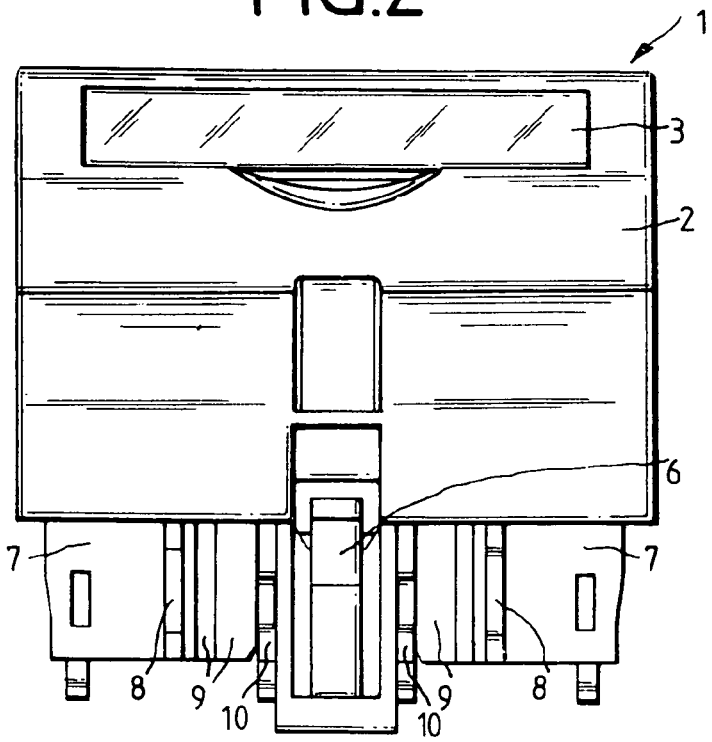
FIG. 2 shows a plan view of the connecting socket.

FIG. 1 shows a front view of the front side of the plastic housing 2 of the connecting socket 1. A transparent cover 3 for an inscription field can be seen relatively centrally. Concave indentations 4 and flaps 5 (which can be used to close openings in female connectors for accommodating male connectors) can be seen in the lower region. As can also be seen in FIG. 2, the housing 2 comprises a latching clip 6, which is used to latch the housing 2 to a front frame (not shown). It should be noted in this case that a further, concealed latching clip is arranged on the opposite side, as can be seen in FIG. 3. Arranged laterally at the lower end are two panel-shaped elements 7 each having an aperture in the form of a slot, in which a latching lug 48 of a latching clip 45, 47 of a guide body 31 in a pressure module 30 engages (see FIG. 6). Arranged on the panel-shaped elements 7 are ribs 8 whose profile can be seen better in FIG. 3. After a short horizontal course, said ribs fall away obliquely and change to a horizontal course again. The rear side of a concave holding element 9, which accommodates the data cable, can be seen next to the panel-shaped element 7. The two concave holding elements 9 are each metallized, with the rear side (which can be seen in FIG. 2) and the front side as well as the side surfaces of the holding element 9 being metallized and electrically connected. Two webs 10, between which the latching lug 48 of the latching clip 45 and 47, respectively, is located in the assembled state, protrude laterally from the latching clip 6.

FIG. 3 shows the rear view of the connecting socket 1 with two pressure modules 30 which have been inserted and shall first of all be explained in more detail with reference to FIGS. 5 to 8. The pressure module 30 comprises a guide body 31, preferably made of plastic, a spring 32 and a cable fixing element 33. The rear wall 34 and the two side walls 35, 36 of the guide body form an essentially U-shaped structure. Arranged on the rear wall 34 is an elongate structure, onto which the spring 32 can be pushed. In this case, the elongate structure may have a circular or else cruciform cross section. An element 37 for hooking into the housing 2 is arranged externally on the rear side of the rear wall 34. On the end face, the cable fixing element 33 is arcuate and has teeth 38, with this arcuate part forming the mating piece for the holding element 9, and the data cable (with or without a shield) being fixed between the two. Two resilient clip-shaped elements 39, 40 are arranged laterally on the cable fixing element 33. In this case, the clip-shaped element 40 extends centrally and is fixed both with respect to the rear side and with respect to the end face, whereas the clip-shaped element 39 is guided exclusively rearward to the rear side. Arranged at the resilient ends of each of the clip-shaped elements 39, 40 is an elevation 41, which is used, in particular, for better actuation using a tool. In the region of the elevations 41, a latching lug 42 is arranged on the side walls of each of the clip-shaped elements 39, 40. When the spring is prestressed, the front latching lug 42 latches into a latching groove 43, and the two rear latching lugs 42 latch into latching grooves 44. FIGS. 5 to 8 show this prestressed state, with the primary holding being effected by the front latching lug 42. If, as a result of pressure on the clip-shaped element 40, for example by means of a tool, the latching lug 42 is then pushed out of the latching groove 43 and is pushed laterally against the elevation 41, the spring 32 is released and moves the cable fixing element 33 forward until the latter abuts against a data cable or latches into a latching clip 45 of the guide body 31. This makes it possible to reliably fix data cables having different diameters and, if need be, to make contact with their shield. Sawtooth-like profiling 46 is provided on the inner surface of the side walls 35, 36. When the cable fixing element is advanced rapidly, the two rear latching lugs 42 then slide over the profiling 46, which prevents them from sliding back, however. A latching lug 48 is arranged on each latching clip 45 and 47, respectively. In the assembled state (see FIG. 3), one latching lug 48 latches into the aperture (in the form of a slot) in the panel-shaped element 7, whereas the other latching lug 48 lies between the two webs 10. A contact tab 49, on which a U-shaped contact element 50 is arranged, branches off from the underside of the cable fixing element 33. In the assembled state, the contact element 50 comes to rest on metallized webs of the housing 2 and produces a second electrical contact path between a shield of a data cable and the metallization of the housing 2. These two electrical paths (via the holding element 9 and the contact element 50) considerably improve the transfer impedance. A respective T-shaped web 51, which is arranged on the inner sides of the side walls 35, 36 and is used as a guide rail for the cable fixing element 33, can also be seen in FIGS. 7 and 8.

As already explained, FIG. 3 shows the assembled state of the connecting socket (without a data cable). In this case, an opening 52 can be seen on the side wall of the housing 2. This opening 52 accommodates a latching lug of a female connector, whereas the corresponding latching lug is located on the other side of the female connector in a cutout in a wall between the two female connectors.

FIG. 4 shows a cross section illustration along the section F-F shown in FIG. 1, in which it is possible to see the position of the female connector 53 in the housing 2. In this case, the metallizations 54 (which can be seen in section) of the housing 2 are shown in black.

Finally, FIG. 9 shows a perspective view of the housing 2 on its own, with the metallizations 54 being shown as black areas. In addition to the metallized holders 9, it is possible to see, in particular, the wall 55 with the cutout 56. It is also possible to see areas 57 which are not metallized. In this case, the large areas 57, in particular, are used to compensate for the capacitive coupling between the contacts in a contact pair and the metallization, that is to say that both contacts in a contact pair have virtually the same capacitive coupling.

LIST OF REFERENCE SYMBOLS

1 Connecting socket
2 Plastic housing
3 Cover
4 Concave indentations
5 Flaps
6 Latching clip
7 Panel-shaped elements
8 Ribs
9 Concave holding element
10 Webs
30 Pressure module
31 Guide body
32 Spring
33 Cable fixing element
34 Rear wall
35 Side wall
36 Side wall
37 Arcuate element
38 Teeth
39 Clip-shaped element
40 Clip-shaped element
41 Elevation
42 Latching lug

43 Latching groove
44 Latching groove
45 Latching clip
46 Sawtooth-like profiling
47 Latching clip
48 Latching lug
49 Contact tab
50 U-shaped contact element
51 T-shaped webs
52 Opening
53 Female connector
54 Metallizations
55 Wall
56 Cutout
57 Areas

The invention claimed is:

1. A pressure module for locking a female connector in a connecting socket, the pressure module comprising:

a guide body having a first, closed end;

a spring having a first end and a second, opposite end, the first end of the spring being mounted to the first end of the guide body; and a cable fixing element coupled to the second end of the spring, wherein the spring is configured to bias the cable fixing element away from the closed end of the guide body.

2. The pressure module as claimed in claim 1, wherein the cable fixing element is made of metal or metallized plastic.

3. The pressure module as claimed in claim 1, wherein the cable fixing element has at least one latching lug and the guide body has at least one latching groove, so that the spring can be latched, with prestress, into the guide body.

4. The pressure module as claimed in claim 3, wherein the cable fixing element has three latching lugs, with two latching lags being arranged laterally on a side of the cable fixing element which faces the spring and one latching lug being arranged laterally on another side of the cable fixing element which faces the cable.

5. The pressure module as claimed in claim 4, wherein the guide body has sawtooth profiling on the inside of the sides.

6. The pressure module as claimed in claim 2, wherein the cable fixing element has a contact tab.

7. The pressure module as claimed in claim 6, wherein the contact tab is bent in a direction of the spring and has a contact element, which makes contact with the metal or metallized plastic.

* * * * *